US006715427B2

(12) United States Patent
Mikich et al.

(10) Patent No.: US 6,715,427 B2
(45) **Date of Patent: *Apr. 6, 2004**

(54) SUSPENDED STORAGE STRUCTURE

(75) Inventors: Michael J. Mikich, Las Vegas, NV (US); Timothy M. Matthias, Las Vegas, NV (US); Mark C. Torosian, Las Vegas, NV (US); Dwayne Dunseath, Las Vegas, NV (US)

(73) Assignee: Hyloft USA, LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/966,929

(22) Filed: Sep. 28, 2001

(65) Prior Publication Data

US 2002/0043189 A1 Apr. 18, 2002

Related U.S. Application Data

(63) Continuation-in-part of application No. 09/690,654, filed on Oct. 17, 2000, now Pat. No. 6,435,105.

(51) Int. Cl.[7] ..... A47B 23/00
(52) U.S. Cl. ..... 108/42; 108/149; 211/113
(58) Field of Search ..... 108/42, 186; 211/113, 211/181.1, 118, 117, 119

(56) References Cited

U.S. PATENT DOCUMENTS

| | | | |
|---|---|---|---|
| 1,566,551 | A | 12/1925 | Ghrand |
| 3,139,045 | A | 6/1964 | Rojakovick |
| 3,735,951 | A | 5/1973 | Reed |
| 3,938,666 | A | 2/1976 | Castleberry |
| 3,945,462 | A | 3/1976 | Griswold |
| 4,061,092 | A | 12/1977 | Jacobsen et al. |
| 4,157,070 | A | 6/1979 | Huempfner et al. |
| 4,167,908 | A | 9/1979 | Jones et al. |

(List continued on next page.)

FOREIGN PATENT DOCUMENTS

| | | |
|---|---|---|
| DE | 100 28 876 C 1 | 7/2001 |
| FR | 72.24575 | 2/1974 |
| FR | 2526648 | 11/1983 |
| GB | 222248 | 10/1924 |
| GB | 1045379 | 10/1966 |
| JP | 339760 | * 11/1992 |
| JP | 8-168416 | 7/1996 |
| JP | 8-254039 | 10/1996 |
| JP | 10-179299 | 7/1998 |
| WO | WO91/16837 | 11/1991 |

OTHER PUBLICATIONS

Industrial Wire Products, Rafter Solutions/Storage Solutions, Installation Instructions, 1996, 2, US.

*Primary Examiner*—Jose V. Chen
(74) *Attorney, Agent, or Firm*—Robert Ryan Morishita; Anderson & Morishita, LLC

(57) ABSTRACT

An overhead storage assembly, vendable as a kit, includes a plurality of panels each of a rectangular platform having dimensions that are integer multiples of conventional structural spacing. The panels may be joined to each other to form a common support surface resting on a plurality of transverse support pieces connected at the ends to hanger assemblies that are attached to the overhead structure of a building. Each panel includes a first plurality of parallel elongate elements and a second plurality of elongate elements aligned perpendicular to the first plurality of parallel elements. Each panel, moreover, may include closely paired elongate elements near a longitudinal edge to increase the sectional stiffness of the panel and to facilitate releasable connection of the panels to the traverse support pieces and hanger assemblies. The hanger assemblies may comprise matching upper and lower straps that are secured to each other at selected suspension lengths.

16 Claims, 4 Drawing Sheets

U.S. PATENT DOCUMENTS

| | | | | |
|---|---|---|---|---|
| 4,289,392 | A | | 9/1981 | Kobori et al. |
| 4,374,498 | A | | 2/1983 | Yellin |
| 4,441,583 | A | | 4/1984 | Vaught |
| 5,011,239 | A | | 4/1991 | Guerin |
| 5,056,878 | A | | 10/1991 | Givens |
| 5,199,843 | A | | 4/1993 | Sferra |
| 5,203,619 | A | | 4/1993 | Welsch et al. |
| 5,215,366 | A | | 6/1993 | Givens |
| 5,242,219 | A | | 9/1993 | Tomaka |
| 5,379,564 | A | | 1/1995 | Wynne |
| 5,542,530 | A | | 8/1996 | Freelander |
| 5,601,038 | A | | 2/1997 | Welch et al. |
| 5,727,700 | A | | 3/1998 | Digney |
| 5,884,567 | A | | 3/1999 | Bartz, Jr. |
| D416,152 | S | | 11/1999 | Payne et al. |
| 6,079,575 | A | | 6/2000 | Wang |
| 6,145,678 | A | | 11/2000 | Morrison |
| 6,161,709 | A | | 12/2000 | Kluge et al. |
| 6,241,106 | B1 | | 6/2001 | Fujita et al. |
| 6,286,691 | B1 | | 9/2001 | Oberhaus et al. |
| 6,299,001 | B1 | * | 10/2001 | Frolov et al. |
| 6,311,626 | B1 | | 11/2001 | Roberts |
| 6,409,031 | B1 | | 6/2002 | Wynne |
| 6,435,105 | B1 | * | 8/2002 | Mikich et al. |
| 6,460,710 | B1 | * | 10/2002 | Dardashti |
| 2002/0023888 | A1 | | 2/2002 | Wynne et al. |

* cited by examiner

SUSPENDED STORAGE STRUCTURE

CROSS REFERENCE TO RELATED APPLICATIONS:

This application is a continuation-in-part of application Ser. No. 09/690,654, filed Oct. 17, 2000 now U.S. Pat. No. 6,435,105.

BACKGROUND OF THE INVENTION

1. Field of the Invention

The present invention relates to storage structures, and more particularly to overhead storage structures conformed for suspended attachment.

2. Description of the Prior Art

Overhead storage structures have been known in the past. Typically the cost and maintenance of storage space are directly related to floor space. As a consequence storage of personal articles is associated with the costs of the housing structure, and the hobbyist, artist, or collector is often forced with the hard choice between cost of storage and artistic pursuit. Similarly, artisans, mechanics and those engaged in business are always exchanging tool or merchandise inventory against the cost of its storage. Accessible storage is therefore uniformly sought.

In the past various storage structures have been devised which in one way or another are deployed overhead. Amongst these are structures associated with lifting mechanisms for raising and lowering the storage assembly, as exemplified in U.S. Pat. No. 5,203,619 to Welsch et al and U.S. Pat. No. 5,199,843 to Sferra. Each of the foregoing, while suitable forthe purposes intended, describes a fairly complex structure that is devoted to lift, and store substantial overhead weights.

Alternatively, other passive or manually articulated overhead storage arrangements have been devised as exemplified in U.S. Pat. No. 5,011,239 to Guerin and U.S. Pat. Nos. 5,215,366 and 5,056,878 to Givens. Again, while suitable for the purposes intended, each of the foregoing entails substantial structural elements which often extend from the ceiling to the floor or present a formidable visual mass that creates the appearance of crowding.

In the recent past, U.S. Pat. No. Des. 416,152 has been issued to Sidney Thomas Payne, and subsequently assigned to the present assignee, describing an ornamental welded wire constructed storage structure suspended on spaced welded wire supports tied to a ceiling. While the welded wire structural implementation provides a somewhat less visually encumbered appearance, further improvements are possible both in the nature of the accommodation thereof to the available spaces and in the manner in achieving positive suspension engagement directly to structural elements and beams. It is these improvements that are disclosed herein.

SUMMARY OF THE INVENTION

Accordingly, it is the general purpose and object of the present invention to provide an overhead storage structure variously formed from standardized welded wire segments.

Other objects of the invention are to provide welded wire modular components that are combined to form overhead storage.

Yet further objects of the invention are to provide a light weight overhead storage assembly that is conveniently suspended from overhead beams.

Briefly, these and other objects are accomplished within the present invention by providing a standardized welded wire module each defined by a welded wire panel reinforced along both longitudinal edges by a plurality of closely grouped wire members. Several of these modules can then be joined to each other to form a support surface stiffened at the common longitudinal sides by the above described plurality of closely grouped wire members.

To provide transverse stiffness, the joined modules are supported by spaced transverse pieces each fixed at the ends to a corresponding lower end of a paired set of support straps, which, at the upper end each strap is then attached to an adapter which is secured to a ceiling beam or other structural member. Each of the straps, in turn, comprises an upper end and a lower overlapping segment fastened to each other by known fasteners such as a nut and a bolt. To allow for fine vertical length adjustment of each of the straps, the respective upper and lower segments may each include a series of evenly spaced bolt openings for fastening the straps to each other at the correct height deployment.

At the upper end, the upper strap segment is again secured by a bolt to a selected opening in the vertical surface of an L-sectioned adapter which, at the horizontal surface, is securable by a screw or bolt directly to the structure of an overhead beam. The several fastening openings in both the vertical and horizontal surfaces of the adapter allow for a substantial offset between the attachment of the strap and the beam fastenings, thereby accommodating a fairly wide scope of choices for the deployment of the inventive storage assembly.

Preferably each of the welded wire modules is dimensioned in integer multiples of standard structural beam spacing and the offset allowable in each adapter is a fraction thereof. In consequence the inventive storage structure can be variously positioned along walls or in other alignments that minimize its optical bulk.

Figure 1:
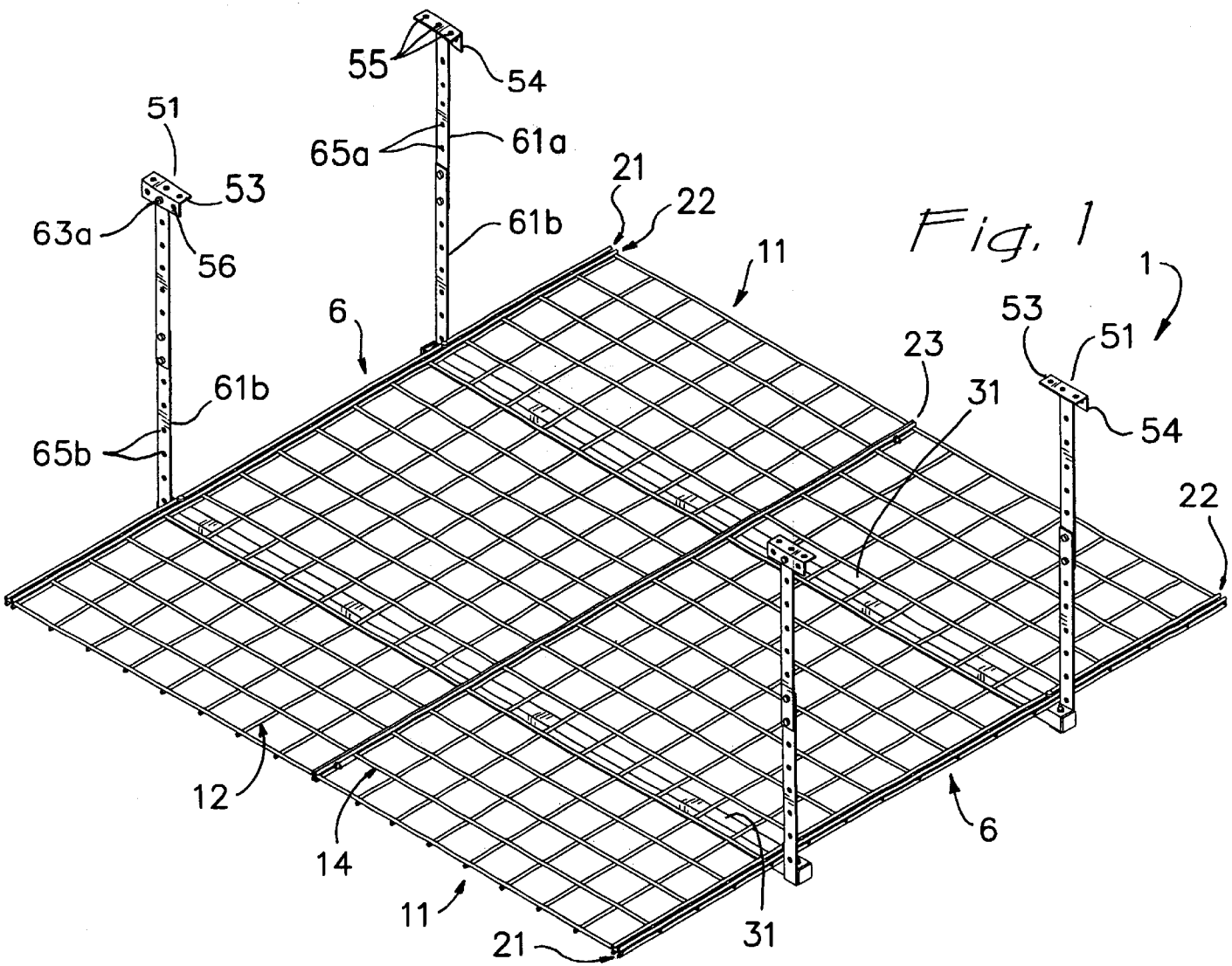
FIG. 1 is a perspective illustration of the inventive overhead storage structure.
Figure 2:
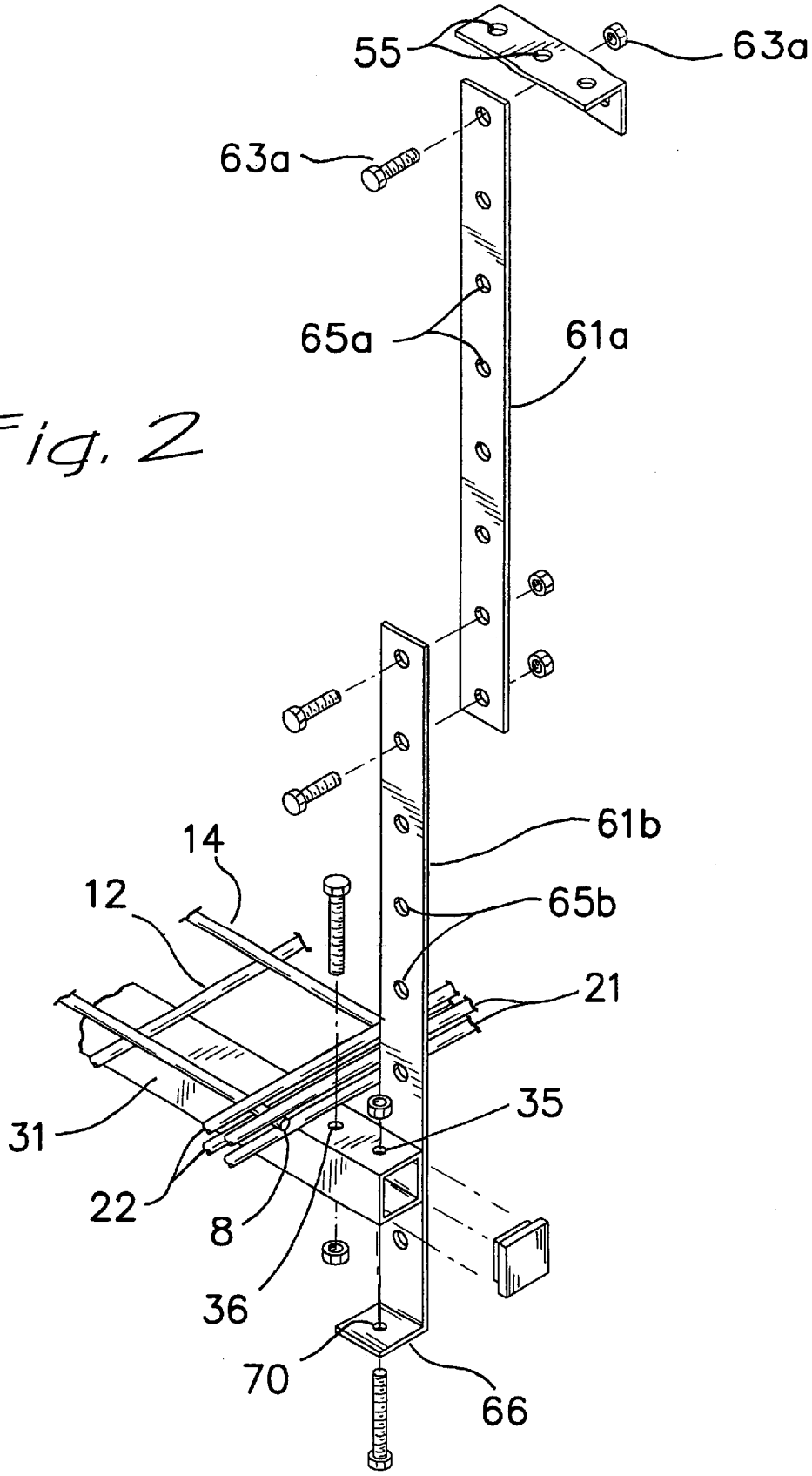
FIG. 2 is a perspective detailed illustration of the attachment means of a welded wire module and a suspension assembly to a traverse piece.
Figure 3:
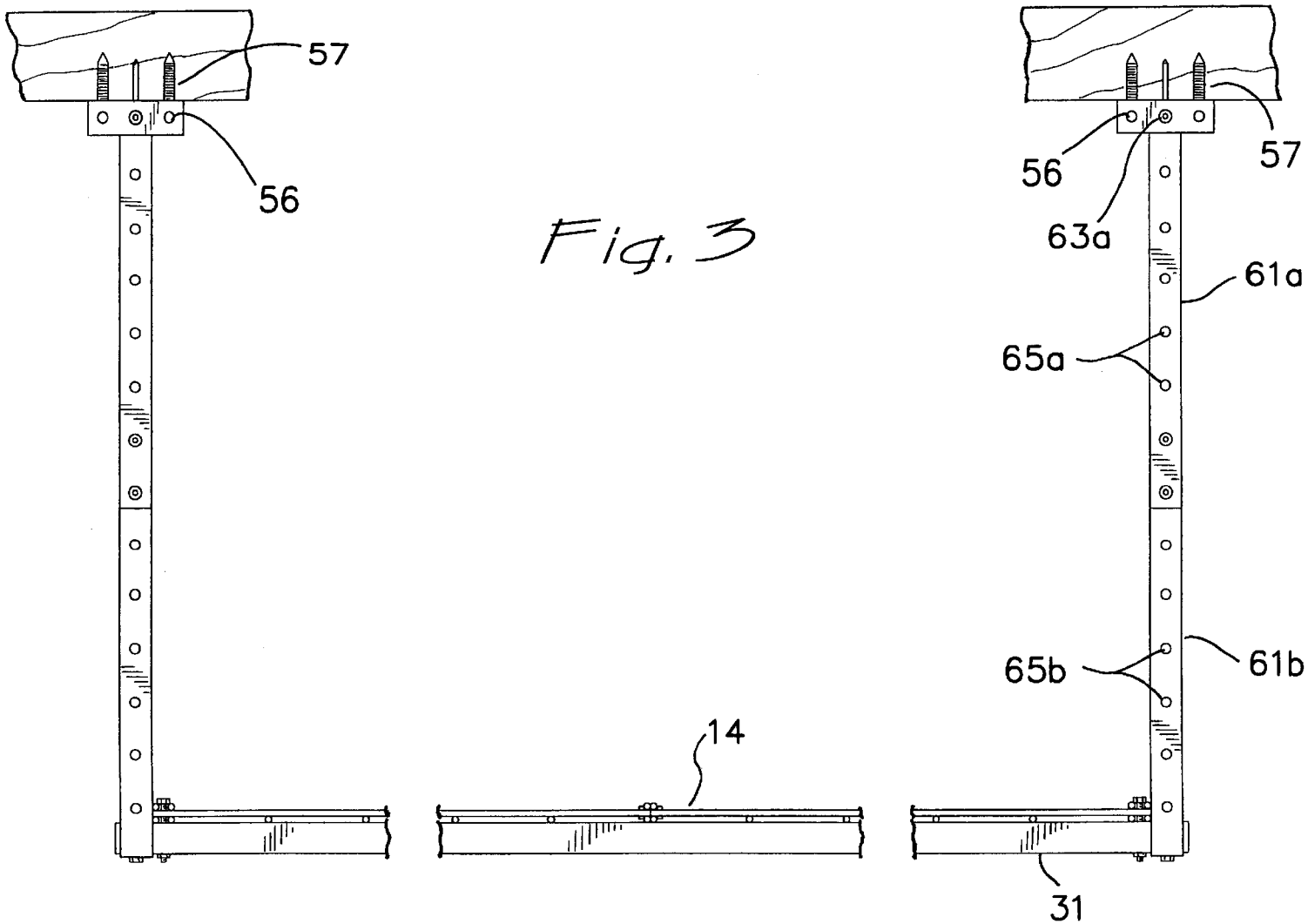
FIG. 3 is an end view of the overhead storage structure as attached to a structural member.
Figure 4:
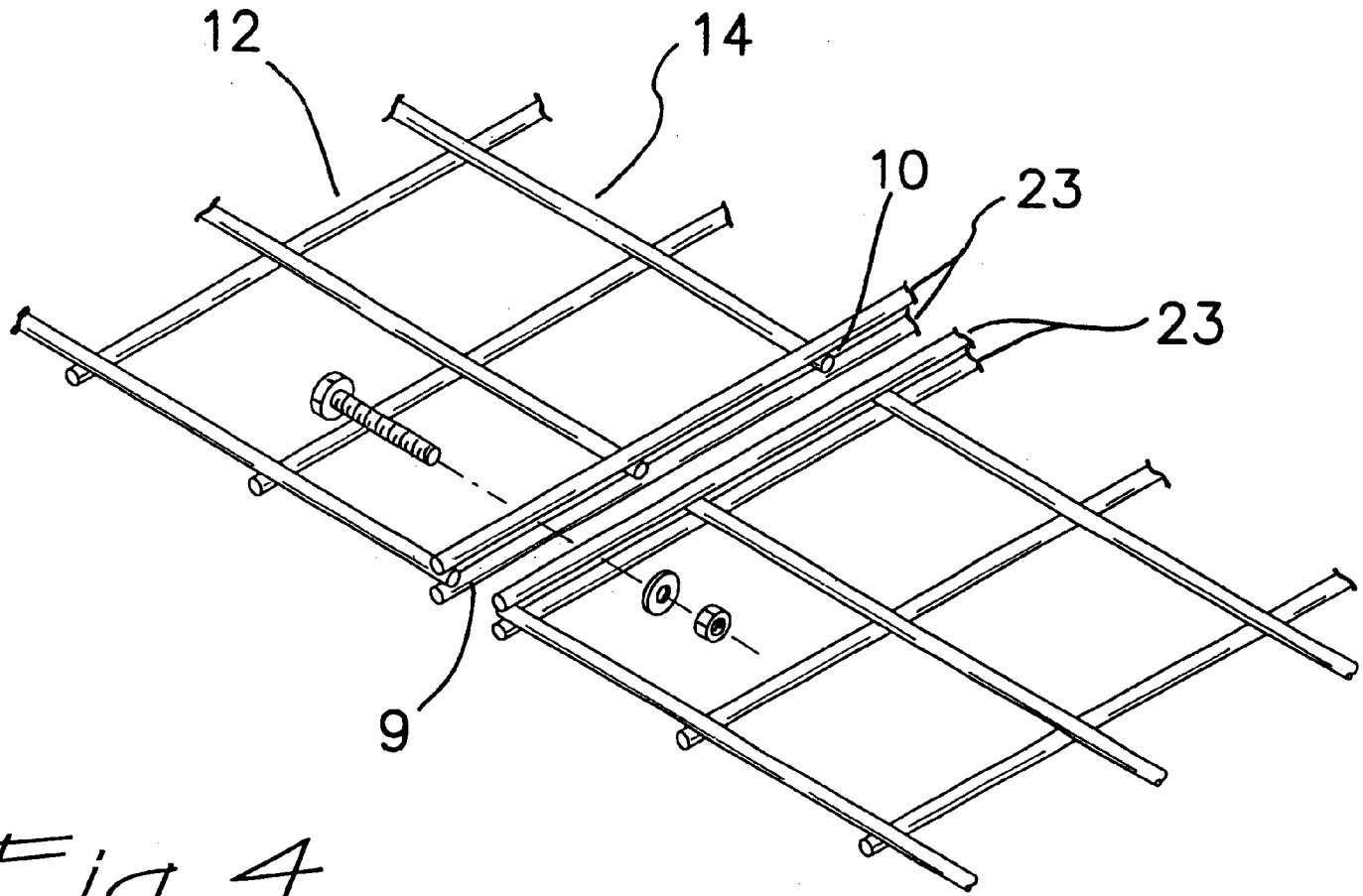
FIG. 4 is a perspective detailed illustration of the attachment means of a first welded wire module to a second welded wire module.

DESCRIPTION OF THE PREFERRED EMBODIMENT:

As shown in FIGS. 1–3 the inventive storage assembly, generally designated by the numeral 1, includes a horizontal storage platform formed by forming a plurality of welded wire panels 11. Each of the panels 11 is defined by a set of parallel rods 12 and a set of perpendicular rods 14 laid above parallel rods 12 and welded to one another to form a welded wire surface element of a platform dimension in integer multiples of conventional structural beam spacing. Along an outer longitudinal edge 6 of the wire panels 11 a first set of two closely paired parallel rods 21 and a second set of two closely paired parallel rods 22 sandwich, above and below, first ends 8 of the perpendicular rods 14. The closely paired parallel rods 21, 22 provide support and allow insertion of a bolt therebetween for reasons more fully described below. Along an inner longitudinal edge 9 of the wire panels 11 a pair of parallel rods 23 sandwich, above and below, second ends 10 of the perpendicular rods 14.

Panels 11 may be joined at their inner longitudinal edges 9 to other adjacent panels to form a common storage surface, the joining being effected by one or more conventional nut, bolt and washer combinations. The joined panels 11 that form the common surface are then supported by several transverse pieces 31, each in the form of a square tube sectioned structural member provided with a set of drillings 35, 36 at each end that are useful for fastening to the joined panels 11 and a suspension structure further described below.

Those in the art will appreciate that the longitudinal dimension of pieces 31 will be in integer multiples of the width of panels 11. Thus, the length of pieces 31 is preferably either one or two widths of panel 11 resulting in an inventive overhead storage structure that allows for storage widths that are either one or two times the width of the panel. Furthermore, current construction practices, regulations and conventions have resulted in preferred spacing intervals of structural members that form a commercial or residential structure. Since these then define the hard points from which the stored articles can be suspended, the preference is to dimension the width and length of each panel 11 in integer multiples of this spacing interval. In this manner the resulting assembly is conveniently accommodated for direct attachment to structural elements.

The example illustrated herein provides transverse pieces 31 of a length that is equal to two (double) widths of panel 11. Thus the inner longitudinal edges 9 of each panel align proximate the middle of each piece 31, and in order to fix this adjoining relationship the inner longitudinal edges 9 of each panel 11 are joined to each other, near a middle of the pieces 31, by one or more nut, bolt and washer combinations. A nut is inserted horizontally between and through the adjacent closely paired parallel rods 23 of each panel 11 being joined. Upon insertion between and through each adjacent closely paired parallel rods 23, a washer and nut are secured to the bolt. In the manner provided, joined panels 11 and transverse pieces 31 combine to form a relatively rigid storage surface which can then be suspended at the end drillings 35, 36.

Those in the art will appreciate further that while the structural spacing intervals are predetermined, the interior walls that separate the structure into forms or divisions do not always align with this structural spacing. As a result, most of the prior art overhead storage systems either do not engage structural members or are deployed away from the walls. Accordingly, either the suspension strength suffers or the overhead storage is suspended in a manner that creates optical and physical incursion.

To avoid the foregoing disadvantages a set of adapters 51 can be provided, each again formed as an L-sectioned structural member defined by a horizontal surface 53 and a vertical surface 54. A set of drillings or holes 55 and 56 is provided respectively in the horizontal and vertical surfaces 53 and 54, and a fastener 57 is passed through the opening 55 that aligns subjacent a beam or structural member SM, to form a direct attachment thereto. Once so fastened the drillings 56 in the vertical surface are then useful in suspending the storage surface.

More precisely an upper strap 61*a* provided with a row of holes 65*a* is fastened by a bolt and nut assembly 63*a* to a selected one of the drillings 56. A second, lower strap 61*b* is provided with a row of openings 65*b* and a formed right-angled end 66 including an opening 70. Said formed right-angled end 66 is connected to the ends of each transverse piece 31 by placing the right-angled end 66 beneath and adjacent the end of the traverse piece 31. To connect strap 61*b* to the traverse piece, a bolt is inserted vertically through a first end drilling 35 and said aligned opening 70 where a nut is applied. Once in position each strap 61*a* and 61*b* are then aligned relative each other and one or more of the openings 65*a* that align with the openings 65*b* are secured to each other, by conventional nut and bolt combinations, connecting straps 61*a* and 61*b* together. Accordingly, adjustments can be made in the length of each suspension assembly accommodating any height variation in the structural beams.

In a similar fashion, joined panels 11 are connected to the traverse pieces 31 by a conventional nut and bolt combination. A bolt is inserted vertically between a first set of two closely paired parallel rods 21 and a second set of two closely paired parallel rods 22 into and through a corresponding aligned drilling 36 in the traverse piece 31 where a nut is applied.

While reference is made to welded structures, such are exemplary only. The foregoing assembly may be implemented in various material structures, and components thereof may be variously fabricated in all known material combinations. Moreover, while the foregoing description illustrates even hole spacing in the suspension elements unequal spacing may be utilized to provide further height adjustment convenience.

Obviously many modifications and variations can be effected without departing from the spirit of the invention set out herein. It is therefore intended that the scope of the invention be determined solely by the claims appended hereto.

We claim:

1. A storage assembly conformed for attachment to the overhead structure of a building, comprising:

a planar panel structure composed of two or more individual panels, said individual panels secured adjacent one another to cooperate to form a continuous panel structure;

a plurality of transverse support pieces subjacent said panel structure, each said support piece projecting beyond said panel structure at both ends thereof;

a corresponding plurality of suspension assemblies each defined by an upper and a lower end and each releasably secured at said lower end thereof to a corresponding end of said transverse support pieces and operatively attached at said upper end to said overhead structure; and an adaptor interposed between said upper ends of each said suspension assembly and said overhead structure transferring load therebetween.

2. Apparatus according to claim 1, wherein said panel structure includes one or more individual panels comprising said first and second plurality of elongate members and said transverse support pieces are each of a length that is an integer multiple of the transverse dimension of said panel.

3. Apparatus according to claim 2 wherein said first plurality of elongate members define a longitudinal direction of the panel.

4. Apparatus according to claim 3, wherein each said suspension assembly includes an upper and a lower strap respectively defining said upper and lower ends, each said strap including a plurality of spaced openings conducive to means for releasably connecting said upper strap to said lower strap.

5. Apparatus according to claim 4 wherein the means for connecting said upper strap to said lower strap is a nut and bolt combination, said bolt being inserted through aligned spaced openings in both said upper strap and said lower strap for mating with said nut.

6. Apparatus according to claim 5 wherein said lower straps further include formed right-angled ends, said formed right-angled ends including an opening, releasably secured to a bottom surface of the traverse support pieces.

7. Apparatus according to claim 6 wherein a first plurality of elongate members includes, adjacent outer longitudinal edges of the panel, one or more closely paired parallel elongate members confining, above and beneath, ends of the second plurality of elongate members.

8. Apparatus according to claim 7 wherein said transverse support pieces are hollow, square sections.

9. Apparatus according to claim 8 wherein said traverse support pieces further include drillings to facilitate releasable connections to the longitudinal edges of the panels and the lower strap of the suspension assemblies.

10. A storage assembly conformed for attachment to the overhead structure of a building, comprising:

a planar support surface composed of two or more individual panels, the outer edges of which are defined by elongate elements;

an attachment clamp securing one of said elongate elements along an outer edge of one of said panels to an adjacent elongate element along an outer edge of an adjacent panel such that said individual panels secured adjacent one another cooperate to form a continuous support surface;

a plurality of transverse support pieces subjacent said panel structure, each said support piece projecting beyond said panel structure at both ends thereof;

a corresponding plurality of suspension assemblies each defined by an upper and a lower end and each releasably secured at said lower end thereof to a corresponding end of said transverse support pieces and operatively attached at said upper end to said overhead structure; and an adaptor interposed between said upper ends of each said suspension assembly and said overhead structure transferring load therebetween.

11. Apparatus according to claim 10, wherein each said suspension assembly includes an upper and a lower strap respectively defining said upper and lower ends, each said strap including a plurality of spaced openings conducive to means for releasably connecting said upper strap to said lower strap.

12. Apparatus according to claim 11 wherein said lower straps further include a formed right-angled end, said formed right-angled end including an opening, releasably secured to a bottom surface of the traverse support pieces.

13. Apparatus according to claim 1 wherein each panel is defined by a grid of elongate elements, the apparatus further comprising an attachment clamp securing one of said elongate elements along an outer edge of one of said panels to an adjacent elongate element along an outer edge of an adjacent panel such that said individual panels secured adjacent one another cooperate to form a continuous support surface.

14. A storage assembly conformed for attachment to an overhead structure of a building, comprising:

a planar support surface including a plurality of generally planar panels, each said panel secured to an adjacent panel to cooperate to form a continuous support surface;

a plurality of transverse support pieces subjacent said support surface, each said support piece projecting beyond said support surface at both ends thereof;

a corresponding plurality of suspension assemblies each defined by an upper and a lower end and each secured at said lower end thereof to a corresponding end of said transverse support pieces and operatively attached at said upper end to said overhead structure wherein each said suspension assembly includes an upper and a lower strap respectively defining said upper and lower ends, each said strap including a plurality of spaced openings receiving a fastener to releasably connect said upper strap to said lower strap; and an adaptor interposed between said upper ends of each said suspension assembly and said overhead structure transferring load therebetween.

15. A storage assembly conformed for attachment to an overhead structure of a building, comprising:

a planar support surface including a plurality of generally planar panels, each said panel secured to an adjacent panel to cooperate to form a continuous support surface;

a plurality of transverse support pieces subjacent said support surface, each said support piece projecting beyond said support surface at both ends thereof;

a corresponding plurality of suspension assemblies each defined by an upper and a lower end and each secured at said lower end thereof to a corresponding end of said transverse support pieces and operatively attached at said upper end to said overhead structure; and an adaptor interposed between said upper ends of each said suspension assembly and said overhead structure transferring load therebetween, wherein said adaptor includes a series of fastening openings in a direction parallel to the overhead structure such that the attachment of said suspension assemblies to said adaptor may be offset from the attachment of said adaptor to said overhead structure.

16. Apparatus according to claim 15, further comprising a triangulation member having two ends, one end of said triangulation member connected to a suspension assembly and the opposite end of said triangulation member connected to the adaptor secured to said suspension assembly.

* * * * *